US005707952A

United States Patent [19]

Lambremont et al.

[11] Patent Number: 5,707,952

[45] Date of Patent: Jan. 13, 1998

[54] THICKENED ACID COMPOSITION

[75] Inventors: Yves Lambremont, Grivegnee; Claude Blanvalet, Angleur, both of Belgium

[73] Assignee: Colgate-Palmolive Company, Piscataway, N.J.

[21] Appl. No.: 639,068

[22] Filed: Apr. 24, 1996

[51] Int. Cl.[6] ..... C11D 3/37

[52] U.S. Cl. ..... 510/362; 510/383; 510/384; 510/390; 510/391; 510/475

[58] Field of Search ..... 510/362, 383, 510/384, 390, 391, 475

[56] References Cited

U.S. PATENT DOCUMENTS

| | | | |
|---|---|---|---|
| 5,076,954 | 12/1991 | Loth et al. | 252/122 |
| 5,393,453 | 2/1995 | Mondin et al. | 510/362 X |
| 5,409,630 | 4/1995 | Lysy et al. | 510/362 X |

*Primary Examiner*—Michael Lusignan
*Attorney, Agent, or Firm*—Richard E. Nanfeldt

[57] ABSTRACT

An acidic thickened composition which is sprayable and readily clings to vertical walls and is effective in removing heavy encrusted lime scale and soap scum.

5 Claims, No Drawings

THICKENED ACID COMPOSITION

FIELD OF THE INVENTION

This invention relates to a thickened cleaner for hard surfaces, such as bathtubs, sinks, tiles, porcelain and enamelware, which removes soap scum, lime scale and grease from such surfaces. The composition is sprayable from a bottle and will cling to a vertical surface. The composition viscosity is almost newtonian but the composition can be easily removed from the wall without excessive mechanical action. More particularly, the invention relates to an acidic composition that is thickened and that can be sprayed onto the surface to be cleaned, rinsed and wiped off and leaving the cleaned surface bright and shiny. The invention also relates to a method for using such compositions.

BACKGROUND OF THE INVENTION

Hard surface cleaners, such as bathroom cleaners and scouring cleansers, have been known for many years. Scouring cleansers normally include a soap or synthetic organic detergent or surface active agent and an abrasive. Such products can scratch relatively soft surfaces and can eventually cause them to appear dull. These products are often ineffective to remove lime scale (usually encrusted calcium and magnesium carbonates) in normal use. Because lime scale can be removed by chemical reactions with acidic media various acidic cleaners have been produced and have met with various degrees of success. In some instances such cleaners have been failures because the acid employed was too strong and damaged the surfaces being cleaned. At other times, the acidic component of the cleaner reacted objectionably with other components of the product which adversely affected the detergent or perfume. Some cleaners required heavy rinsing afterward to avoid leaving objectionable deposits on the cleaned surfaces. As a result of research performed in efforts to overcome the mentioned disadvantages there has recently been made an improved liquid cleaning composition which is an effective cleaner to remove soap scum, lime scale and greasy soils from hard surfaces, such as bathroom surfaces. Such a product is described in U.S. Pat. No. 5,076,954 which patent is hereby incorporated by reference. In particular, Example 3 of that application discloses an acidic, clear, oil-in-water microemulsion which is therein described as being successfully employed to clean shower wall tiles of lime scale and soap scum that had adhered to them. Such cleaning was effected by applying the cleaner to the walls followed by wiping or minimal rinsing after which the walls were allowed to dry to a god shine.

The described thickened microemulsion cleaner of U.S. Pat. No. 5,076,954 is effective in removing lime scale and soap scum from hard surfaces and is easy to use, but it has been found that its mixture of acidic agents (succinic, glutaric and adipic acids) could damage the surfaces of some hard fixtures, such as those of materials which are not acid resistant and was not effective to remove heavy encrusted lime scale. One of such materials is an enamel that has been extensively employed in Europe as a coating for bathtubs, herein referred to as European enamel. It has been described as zirconium white enamel or zirconium white powder enamel and has the advantage of being resistant to detergents, which makes it suitable for use on tubs, sinks, shower tiles and bathroom enamelware. However, such enamel is sensitive to acids and is severely damaged by use of the microemulsion acidic cleaner based on the three organic carboxylic acids previously mentioned. This problem was been solved by EPO Patent Application No. 0336878A2, wherein additional acidic materials were incorporated in the cleaner with the organic acids and rather than exacerbating the problem, they prevent harm to such European enamel surfaces by such organic acids. Also, a mixture of such additional acids, phosphonic and phosphoric acids surprisingly further improves the safety of the aqueous cleaner for use on such European enamel surfaces and decreases the cost of the cleaner.

The instant compositions of the present invention allow the cleaning of very encrusted enamel surfaces, as well as any other acid resistant surfaces of bathtubs and other bathroom surfaces. Additionally, the instant compositions are stable at 25° C. for at least 3 months.

SUMMARY OF THE INVENTION

In accordance with the present invention, a thickened acidic aqueous cleaner for bathtubs and other hard surfaced items, which are acid resistant or are of zirconium white enamel, wherein the cleaner has a pH in the range of 1 to 4 and the cleaner removes lime scale, soap scum and greasy soil from surfaces of such items comprises a thickener; a detersive proportion of at least one synthetic organic detergent which is capable of removing greasy soil from such surfaces; a lime scale and soap scum removing proportion of an acid, especially a mono or dicarboxylic acid(s) having 2 to 10 carbon atoms or an alpha hydroxy aliphatic acid, and optionally, an aminoalkylenephosphonic acid in such proportion as to prevent damage to zirconium white enamel surfaces of items to be cleaned by the carboxylic acid(s), a perservative, phosphoric acid, and a disinfectant and the balance being water.

DETAILED DESCRIPTION OF THE INVENTION

The instant invention relates to a thickened acidic compositions which comprises approximately by weight:

(a) 0 to 5 percent of an anionic surfactant such as triethanolamine lauryl sulfate;

(b) 0 to 5 percent of a nonionic surfactant having 1 to 8 ethoxylate groups and an alkyl group have 6 to 22 carbon atoms;

(c) 0 to 0.7 percent of a preservative such as an alkali metal benzoate such as sodium benzoate;

(d) 0.3 to 2.5 percent of a hydrophobically modified polyurethane thickener;

(e) 0 to 10 percent of a disinfectant such as $H_2O_2$ and/or a tetraalkyl ammonium chloride;

(f) 0 to 1.0 percent, more preferably 0.05 to 1.0 percent of phosphoric acid;

(g) 0 to 0.5 percent of an amino trismethylene phosphonic acid;

(h) 1 to 10 percent of an acid, especially a mono or dicarboxylic acid having 2 to 10 carbon atoms or an alpha hydroxy aliphatic acid;

(i) 0 to 2.0 percent of a perfume, essential oil, or water insoluble hydrocarbon; and (j) balance being water, wherein the composition has a pH of about 1 to about 4, more preferably about 2.0 to about 3.3 and a Brookfield viscosity of about 200 to 500 cps at 25° C. using a #2 spindle and 50 rpms.

In the present compositions, the synthetic organic detergent may be a nonionic surfactant or a mixture of a nonionic surfactant and an alkyl sulfonate anionic surfactant, amphoteric or mixtures thereof.

The nonionic surfactant that can be employed in present liquid detergent composition is present in amounts of about 0.1 to 5%, preferably 0.5 to 4.5%, most preferably 1 to 4%, by weight of the composition and provides superior performance in the removal of soil, and associates with the polymer to impart viscosity to the product.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such as Plurafacs (BASF) and condensates of ethylene oxide with sorbitan fatty acid esters such as the Tweens (ICI). The nonionic synthetic organic detergents generally are the condensation products of an organic alphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent. Further, the length of the polyethenoxy hydrophobic and hydrophilic elements.

The nonionic detergent class includes the condensation products of a higher alcohol (e.g., an alkanol containing about 6 to 22 carbon atoms, more preferably 8 to 18 carbon atoms, in a straight or branched chain configuration) condensed with about 1 to 8 moles of ethylene oxide, for example, lauryl or myristyl alcohol condensed with about 4 moles of ethylene oxide (EO), tridecanol condensed with about 6 to moles of EO, myristyl alcohol condensed with about 6 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 8 moles of EO per mole of alcohol and tallow alcohol ethoxylates containing 6 EO to 8 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), and the like. Such ethoxamers have an HLB (hydrophobic lipophilic balance) value of about 6 to 11 and give good O/W emulsification. The especially preferred monionics are Dobanol $C_9$–$C_{11}$ EO2.5:1 , $C_9$–$C_{11}$ EO5:1 and $C_9$–$C_{11}$ EO8:1 from Shell Company.

In partial or total replace of the nonionic surfactant one can use a composition (herein after referred to as ethoxylated glycerol type compound) which is a mixture of a fully esterified ethoxylated polyhydric alcohol, a partially esterified ethoxylated polyhydric alcohol and a nonesterified ethoxylated polyhydric alcohol, wherein the preferred polyhydric alcohol is glycerol, and the compound is Formula (I)

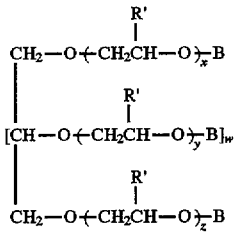

and

Formula (II)

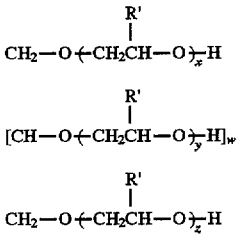

wherein w equals one to four, most preferably one. B is selected from the group consisting of hydrogen or a group represented by:

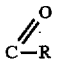

wherein R is selected from the group consisting of alkyl group having 6 to 22 carbon atoms, more preferably 11 to 15 carbon atoms and alkenyl groups having 6 to 22 carbon atoms, more preferably 11 to 15 carbon atoms, wherein a hydrogenated tallow alkyl chain or a coco alkyl chain is most preferred, wherein at least one of the B groups is represented by said

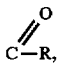

and R' is selected from the group consisting of hydrogen and methyl groups; x, y and z have a value between 0 and 60, more preferably 0 to 40, provided that (x+y+z) equals 2 to 100, preferably 4 to 24 and most preferably 4 to 19, wherein in Formula (I) the ratio of monoester/diester/triester is 45 to 90/5 to 40/1 to 20, more preferably 50 to 90/9 to 32/1 to 12, wherein the ratio of Formula (I) to Formula (11) is avalue between 3 to 0.02, preferably 3 to 0.1, most preferably 1.5 to 0.2, wherein it is most preferred that there is more of Formula (II) than Formula (I) in the mixture that forms the compound.

The ethoxylated glycerol type compound used in the instant composition is manufactured by the KAO Corporation and sold under the trade name Levenol such as Levenol F-200 which has an average EO of 6 and a molar ratio of coco fatty acid to glycerol of 0.55 or Levenol V501/2 which has an average EO of 17 and a molar ratio of tallow fatty acid to glycerol of 1.0. It is preferred that the molar ratio of the fatty acid to glycerol is less than 1.7, more preferably less than 1.5 and most preferably less than 1.0. The ethoxylated glycerol type compound has a molecular weight of 400 to 1600, and a pH (50 grams/liter of water) of 5–7. The Levenol compounds are substantially non irritant to human skin and have a primary biodegradabillity higher than 90% as measured by the Wickbold method Bias-7d.

Two examples of the Levenol compounds are Levenol V-501/2 which has 17 ethoxylated groups and is derived from tallow fatty acid with a fatty acid to glycerol 0 ratio of 1.0 and a molecular weight of 1465 and Levenol F-200 has 6 ethoxylated groups and is derived from coco fatty acid with a fatty acid to glycerol ratio of 0.55. Both Levenol F-200 and Levenol V-501/2 are composed of a mixture of Formula (I) and Formula (II). The Levenol compounds has ecoxicity values of algae growth inhibition>100 mg/liter; acute toxicity for Daphniae>100 rag/liter and acute fish toxicity>100 mg/liter. The Levenol compounds have a ready biodegradability higher than 60% which is the minimum required value according to OECD 301B measurement to be acceptably biodegradable.

Polyesterified nonionic compounds also useful in the instant compositions are Crovol PK-40 and Crovol PK-70 manufactured by Croda GMBH of the Netherlands. Crovol PK-40 is a polyoxyethylene (12) Palm Kernel Glyceride which has 12 EO groups. Crovol PK-70 which is preferred is a polyoxyethylene (45) Palm Kernel Glyceride have 45 EO groups.

The anionic surfactant, used in the composition, constitutes about 0 to 5%, preferably 0.1% to 4%, most preferably 0.3% to 3% by weight.

The anionic surfactant which may be used in the instant composition of the invention are water soluble such as triethanolamine salt and include the sodium, potassium, ammonium and ethanalommonium salts of $C_{8-18}$ alkyl sulfates such as lauryl sulfate, myristyl sulfate and the like.

The alkyl sulfate anionic detergent compounds which are useful in the present invention have from 6 to 18 in the alkyl group and can be represented by the following general formula:

$$R^2SO_4M$$

in which $R^2$ is straight or branched chain alkyl of from 6 to 8, especially from 8 to 14 carbon atom chain length and M is an alkali metal or ammonium carbon, especially sodium. Straight chain alkyl groups are preferred.

The active acidic component of the acidic emulsions is either a mineral or an organic acid, especially mono or a dicarboxylic acid or an alpha hydroxy aliphatic acid which is strong enough to lower the pH of the microemulsion to one in the range of one to four. Various such carboxylic acids can perform this function but those which have been found effectively to remove soap scum and lime scale from bathroom surfaces best, while still not destabilizing the emulsion, are alpha hydroxy aliphatic acids having the structure:

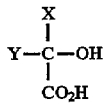

wherein Y is selected from the group consisting of hydroxy or a COOH group and X is $(CH_2)_nW$, wherein W is selected from the group consisting of $CH_3$ or COOH and n is 0, 1, or 2. Preferred alpha hydroxy aliphatic acids are citric acid, lactic acid and malic acid, wherein a mixture of lactic acid and malic acid is preferred, wherein the weight ratio of lactic acid to malic acid is preferred to be about 5:1 to about 1:1, more preferably about 4:1 to about 1:1. The at least one alpha hydroxy aliphatic acid is incorporated in the composition in an amount of about 2 to about 9 wt. %, more preferably about 2 to about 7 wt. %.

The dicarboxylic acid which is strong enough to lower the pH of the microemulsion to one in the range of one to four. Various such dicarboxylic acids can perform this function but those which have been found effectively to remove soap scum and lime scale from bathroom surfaces best, while still not destabilizing the emulsion, and of these the dicarboxylic acids are preferred. Of the dicarboxylic acids group, which includes those of 2 to 10 carbon atoms, from oxalic acid through sebacic acid suberic, azelaic and sebacic acids are of lower solubilities and therefore are not as useful in the present emulsions as the other dibasic aliphatic fatty acids, all of which are preferably saturated and straight chained. Oxalic and malonic acids, although useful as reducing agents too, may be too strong for delicate hard surface cleaning. Preferred such dibasic acids are those of the middle portion of the 2 to 10 carbon atom acid range, succinic, glutaric, adipic and pimelic acids, especially the first three thereof, which fortunately are available commercially, in mixture. Citric acid can also be employed as the acid.

The mono or dicarboxylic acid or alpha hydroxy aliphatic acid, after being incorporated in the thickened acidic emulsion, may be partially neutralized to produce the desired pH in the emulsion, for greatest functional effectiveness, with safety.

Phosphoric acid is one of the additional acids that helps to protect acid-sensitive surfaces being cleaned with the present emulsion cleaner. Being a tribasic acid, it too may be partially neutralized to obtain an emulsion pH in the desired range. For example. It may be partially neutralized to the biphosphate, e.g., $N_aH_2PO_4$, or $NH_4H_2PO_4$.

Phosphonic acid, the other of the two additional acids for protecting acid-sensitive surfaces from the dissolving action of the dicarboxylic acids of the present thickened emulsions, apparently exists only theoretically, but its derivatives are stable and are useful in the practice of the present invention. Such are considered to be phosphonic acids as that term is used in this specification. The phosphonic acids are of the structure:

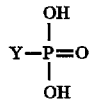

wherein Y is any suitable substituent, but preferably Y is alkylamino or N-substituted alkylamino. For example, a preferred phosphonic acid component of the present thickened acidic emulsions is aminotris (methylenephosphonic) acid which is of the formula N $(CH_2PH_xO_3)$. Among other useful phosphonic acids are ethylene diamine tetra-(methylenephosphonic) acid, hexamethylenediamine tetra-(methylenephosphonic) acid, and diethylenetriamine penta-(methylenephosphonic) acid. Such class of compounds may be described as aminoalkylenephosphonic acids containing in the ranges of 1 to 3 amino nitrogen, 3 or 4 lower alkylenephosphonic acid groups in which the lower alkylene is of 1 or 2 carbon atoms, and 0 to 2 alkylene groups of 2 to 6 carbon atoms each, which alkylene(s) is/are present and join amino nitrogen when a plurality of such amino nitrogen is present in the aminoalkylenephosphonic acid. It has been found that such aminoalkylenephosphonic acids, which also may be partially neutralized at the desired pH of the microemulsion cleaner, are of desired stabilizing and protecting effect in the invented cleaner, especially when present with phosphate acid, preventing harmful attacks on European enamel surfaces by the diacid(s) components of the cleaner. Usually the phosphorus acid salts, if present, will be monosalts of each of the phosphoric and/or phosphonic acid groups present.

The thickener which is used in the thickened acidic composition is a hydrophobically-modified polyurethane nonionic polyol polymer thickener which has a molecular weight of about 1,000 to 1,000,000 such as Acusol 880 sold by the Rohm & Haas Co. Acusol 880 is a viscous liquid containing about 34 to about 36 wt. % of polyurethane/polyol resin, about 38 to about 40 wt. % of propylene glycol and the balance being water. The thickener is used in a concentration of about 0.3 to about 2.5 weight percent, more preferably 0.4 to 2.0 weight percent. When the thickener is used at these concentration levels, the composition is sprayable and will nicely cling to a vertical wall. Additionally, the compositions having the thickener incorporates therein are almost newtonian which means that the composition sticks well to the surface to be cleaned allowing the acid to fully play its function. If other thickeners such as cellulose, hydroxypropyl cellulose, polyacrylate polyacrylamides and polyvinyl alcohol are used in the composition in place of the polyurethane/polyol thickener, the resulting composition will be either physically unstable or will not be sprayable. Additionally, a major requirement of the instant composition is that the composition is stable at 25° C. for at least 30 days. A composition is stable when it remains as a homogenous one phase composition and there is no phase separation or precipitation.

The water that is used in making the present composition may be tap water but is preferably of low hardness, normally being less than 150 parts per million (p.p.m.) of hardness. Still, useful cleaners can be made from tap waters that are higher in hardness, up to 3000 p.p.m. Most preferably the water employed will be distilled or deionized water, in which the content of hardness ions is less than 25 p.p.m.

Various other components may desirably be present in the invented cleaners at concentrations of 0 to 10 wt. %, more preferably 0.5 wt. % to 7.0 wt. %. These components include triethanolamine, preservatives such as sodium benzoate, disinfectants such as hydrogen peroxide and/or didecyl dimethyl ammonium chloride, antioxidants or corrosion inhibitors, cosolvents, cosurfactant, perfumes, colorants and terpenes (and terpineols), but various other adjuvants conventionally employed in liquid detergents and hard surface cleaners may also be present, provided that they do not interfere with the cleaning and scum-and scale-removal functions of the cleaner. Of the various adjuvants (which are so identified because they are not necessary for the production of an operative cleaner, although they may be very desirable components of the cleaner) the most important are considered to be the perfumes, which, with terpenes, terpineols and hydrocarbons (which may be substituted for the perfumes or added to them) function as especially effective solvents for greasy soils on hard surfaces being leaned.

The various perfumes include esters, ethers, aldehydes, alcohols and alkanes employed in perfumery but of most importance are the essential oils that are high in terpene content.

In the invented cleaners it is important that the proportions of the components are in certain ranges so that the product may be most effective in removing greasy soils, lime scale and soap scum, and other deposits from the hard surfaces subjected to treatment, and so as to protect such surfaces during such treatment. As was previously referred to the surfactant should be present in detersive proportion, sufficient to remove greasy and oily soils; the proportion(s) of carboxylic acid(s) should be sufficient to remove soap scum and lime scale; the phosphonic acid or phosphoric and phosphonic acids mixture should be enough to prevent damage of acid sensitive surfaces by the carboxylic acid(s); and the aqueous medium should be a solvent and suspending medium for the required components and for any adjuvants that may be present, too. Normally, such percentages of components will be by weight: 0.3 to 2.5 polycarboxylate thickener, 0 to 5% of synthetic anionic organic detergent(s), 0 to 5% of synthetic organic nonionic detergent(s), 2 to 6% of alpha hydroxy aliphatic acids or dicarboxylic acids, 0 to 1.0% of phosphoric acid or mono-salt thereof and 0 to 0.5% of phosphonic acid(s), aminoalkylenephosphonic acid(s), or mono-phosphonic salt(s) thereof: and the balance water and adjuvant(s) if any are present. Of the acids, it is preferred that citric acid or a mixture of succinic, glutaric and adiplo acids be employed, and the ratio thereof will most preferably be in the range of 1–3:1–6:1–2, within 1:1:1 and about 2:5:1 ratios being most preferred. The ratios of phosphonic acid (preferably aminoalkylenephosphonic acid) to phosphoric acid to aliphatic carboxylic diacids (or carboxylic acids) are usually about 1:1–20:20–500, preferably being 1:2–10; 10–200 and more preferably being about 1:4:25,1:7:170 and 1:3:25, in three representative formulas. However, one may have ranges as wide as 1: 1–2,000: 10–4,000 and sometimes the preferred range of phosphonic acid to dicarboxylic acid is 5:1 to 250:1. Similarly, a mixture of succinic, glutaric and adipic acids may be of ratio of 0.8–4: 0.8–10:1. Also, the percentage of perfume will normally be in the 0.1 to 2% range, preferably being in the 0.5 to 1.5% range and the perfume contains terpene or terpineol. The terpineol is alpha-terpineol and is preferably added to allow a reduction in the amount of perfume, with the total perfume (including the alpha-terpineol) being 50 to 90% of terpineol, preferably about 80% thereof.

The pH of the various preferred-cleaners is usually 1 to 4, preferably 1.5 to 3.5, preferably 2.5. The water content of the thickened compositions will usually be in the range of 75 to 90%, preferably 80 to 85% and the adjuvant content will be from 0 to 5%, usually 1 to 3%. If the pH is not in the desired range it will usually be adjusted with either sodium hydroxide or suitable acid, e.g. sulfuric acid, but normally the pH will be raised, not lowered, and it if is to be lowered more of the dicarboxylic acid mixture can be used, instead.

The liquid cleaners can be manufactured by mere mixing of the various components thereof, with orders or additions not being critical. However, it is desirable for the thickener to be first mixed with the water, various water soluble components to be mixed together into the thickener solution, the oil soluble components to be mixed together in a separate operation, and the two mixes to be admixed, with the oil soluble portion being added to the water soluble portion (in the water) with stirring or other agitation.

In some instances, such procedure may be varied to prevent any undesirable reactions between components. For example, one would not add concentrated phosphoric acid directly to a dye, but such additions would be of aqueous solutions, preferably dilute of the components.

The cleaner may desirably be packed in manually operated spray dispensing containers, which are usually and preferably made of synthetic organic polymeric plastic material, such as polyethylene, polypropylene, polyvinyl chloride (PVC) or Polyethylene Terephtalate. Such containers also preferably include nylon or other non-reactive plastic closure, spray nozzle, dip tube and associated dispenser parts, and the resulting packaged cleaner is ideally suited for use in "spray and wipe" applications. However, in some instances, as when lime scale and soap scum deposits are heavy, the cleaner may be left on until it has dissolved or loosened the deposit(s) and may then be wiped off, or may be rinsed off, or multiple applications may be made, followed by multiple removals, until the deposits are gone.

The following examples in wt. % illustrates but do not limit the invention. All parts, proportions and percentages in the examples, the specification and claims are by weight and all temperatures are in °C. unless otherwise indicated.

Example 1

| | A | B | C | D | E | F | G | H |
|---|---|---|---|---|---|---|---|---|
| Water | Bal. | Bal. | Bal. | Bal. | Bal. | Bal. | Bal. | |
| Acusol 880 | | | | 1.0 | 1.0 | 1.0 | 1.33 | |
| Xanthan Gum | 0.5 | | | | | | | |
| Cellulose | | 0.80 | | | | | | |
| Polyacrylates | | | | | | | | 1.0 |
| Laponite clay | | | 2.00 | | | | | |
| Triethanolamine Lauryl Sulfate | 3.00 | 3.00 | 3.00 | | | 7.15 | | 3.0 |
| Dobanol 91 '2.5 EO | | | | 1.00 | | 2.00 | 1.00 | |
| Dobanol 91 '8 EO | 2.25 | 2.25 | 2.25 | | 1.00 | 2.25 | | 2.25 |
| Sokalan DCS | | | | | 5.00 | | 5.00 | |
| Citric acid | 3.75 | 3.75 | 3.75 | 5.00 | | 3.75 | | 3.75 |
| $H_2O_2$ 30% sol. | | | | 6.67 | | | | |
| Bardac 22 | | | | 0.10 | | | | |
| Perfume | 0.50 | 0.50 | 0.50 | 0.50 | 0.50 | 0.50 | 0.50 | 0.50 |
| Triethanolamine | 1.50 | 1.50 | | | | 1.5 | | |
| Physical stability | Good (10) | Good (10) | 2 Phases (0) | Good (8) | Good (8) | Good (8) | Good (8) | 2 Phases (0) |
| Viscosity | 2000 cps | 400 cps | 100 cps* | 500 cps | No visc. | 380 cps | 410 cps | 100 cps |
| pH | 3.00 | 3.00 | 3.00 | 1.80 | 2.00 | 3.00 | 2.00 | 3.0 |
| Sprayability | Bad (4) | Bad (2) | Good* (6) | Good (8) | Best (10) | Good (8) | Good (6) | Good (6) |
| Cling effect | Good (6) | Medium (4) | Good* (6) | Best (8) | No (0) | Good (6) | Good (6) | Good (6) |

The compositions (A–H) were made by dissolving the thickeners and then dissolving the detergents in the water, after which the rest of the water soluble materials are added to the detergent solution, with stirring, except for the perfume and any adjusting agent (sodium hydroxide solution). The pH is adjusted to the desired value and then the perfume is stirred into the aqueous solution. The physical stability, sprayability and cling effect were graded visually on a scale of 1 to 10 with 1 being the worse and ten the best.

The acid cleaner is packed in polyethylene squeeze bottle equipped with polypropylene spray nozzles which are adjustable to closed spray and stream positions. In use the composition is sprayed onto "bathtub ring" on a bathtub, which also includes lime scale, in addition to soap scum and greasy soil. The rate of application is about 5 ml. per 5 meters of ring (which is about 3 cm. wide). After application and a wait of about two minutes the ring is wiped off with a sponge and is sponged off with water, it is found that the greasy soil, soap scum, and even the lime scale, have been removed effectively. In those cases where the lime scale is particularly thick or adherent a second application may be desirable, but that is not considered to be the norm.

The tub surface is rinsed; it is so easy to rinse a bathtub (or a shower).

In other uses of the cleaner, it may be employed to clean shower tiles, bathroom floor tiles, kitchen tiles, sinks and enamelware, generally, without harming the surfaces thereof. It is recognized that many of such surfaces are acid-resistant but a commercial product must be capable of being used without harm on even less resistant surfaces, such as European enamel (often on a cast iron or sheet steel base) which is sometimes referred to as zirconium white powder enamel. It is a feature of some of the cleaners described above (and other cleaners of this invention) that they clean hard surfaces effectively but they do contain ionizable acids and therefore should not be applied to acid-sensitive surfaces. Nevertheless, it has been found that some do not harm European white enamel bathtubs, in this example, which are seriously affected by cleaning with preparations exactly like that of this example except for the omission from them of the phosphonic acid or the phosphoric-phosphoric acid mixture.

What is claimed:

1. A thickened, shear thinning acidic compositions which comprises approximately by weight:

(a) 0 to 5 percent of an anionic surfactant;

(b) 1 to 5 percent of a nonionic surfactant;

(c) 0 to 1.0 percent of a preservative;

(d) 0.3 to 2.5 percent of a polyurethane/polyol polymeric thickener having a molecular weight of about 1,000 to about 1,000,000;

(e) 0 to 10 percent of a disinfectant;

(f) 0 to 1.0 percent of phosphoric acid;

(g) 0 to 0.5 percent of an amino alkylene phosphonic acid;

(h) 1 to 10 percent of a mono or dicarboxylic acid;

(i) 0.1 to 2 percent of a perfume, essential oil or water insoluble hydrocarbon;

(j) 0 to 10 % of a mineral acid; and (k) the balance being water, wherein the composition has a pH of about 1 to about 4 and a Brookfield viscosity of about 200 to 1,000 cps at R.T. using a #2 spindle at 50 rpms.

2. A composition according to claim 1, in which the carboxylic acid is a dicarboxylic acid and the ratio of dicarboxylic acid to said aminoalkylenephosphonic acid is in the range of 5:1 to 250:1.

3. A composition according to claim 1 wherein the anionic surfactant is a water soluble salt of a lipophilic organic sulfuric acid and wherein the nonionic surfactant is a condensation product of a lipophilic alcohol or phenol with lower alkylene oxide, and wherein the aminoalkylenephosphonic acid is selected from the group consisting of aminotris-(methylene-phosphonic acid), ethylenediamine tetra-(methylenephosphonic acid), hemamethylene diamine tetra-(methylenephosphonic acid) and diethylenetriamine penta-(methylenephosphonic acid) and mixtures thereof.

4. A composition according to claim 1, wherein said carboxylic acid is an alpha hydroxy alphatic acid.

5. A composition according to claim 1, wherein the acid is a monocarboxylic acid.

* * * * *